United States Patent [19]

Oguri

[11] 4,210,794

[45] Jul. 1, 1980

[54] TURNTABLE DRIVE IN A MICROWAVE OVEN

[75] Inventor: Ichiro Oguri, Yao, Japan

[73] Assignee: Sharp Kabushiki Kaisha, Osaka, Japan

[21] Appl. No.: 800,478

[22] Filed: May 25, 1977

[30] Foreign Application Priority Data

May 26, 1976 [JP] Japan ..... 51-67829

[51] Int. Cl.[2] ..... H05B 9/06

[52] U.S. Cl. ..... 219/10.55 F; 126/41 A

[58] Field of Search ..... 219/10.55 B, 10.55 F, 219/10.55 A, 10.55 E; 108/20, 139, 103; 248/349; 274/1 C, 39 R, 39 A; 126/41 A, 182, 338; 198/803; 211/77, 78, 95; 99/443

[56] References Cited

U.S. PATENT DOCUMENTS

| | | | |
|---|---|---|---|
| 3,300,615 | 1/1967 | Smith | 219/10.55 F |
| 3,373,259 | 3/1968 | Smith | 219/10.55 F |
| 4,037,071 | 7/1977 | Kaufman, Jr. | 219/10.55 F |
| 4,121,078 | 10/1978 | Takano et al. | 219/10.55 F |

*Primary Examiner*—Arthur T. Grimley

*Attorney, Agent, or Firm*—Birch, Stewart, Kolasch & Birch

[57] ABSTRACT

A microwave oven comprising a turntable adapted to rotate a foodstuff mounted thereon, said turntable being disposed at the base portion of the microwave oven. The turntable includes a circularly formed geared portion provided at the peripheral portion of the lower surface thereof. A turntable drive mechanism is associated with the geared portion of the turntable to rotate the turntable at a fixed speed. The turntable drive mechanism comprises a motor, a drive gear associated with the geared portion of the turntable, and a metal gear box and a metal reflector secured around and within said drive gear for protecting the drive gear from the microwave energy.

17 Claims, 2 Drawing Figures

TURNTABLE DRIVE IN A MICROWAVE OVEN

BACKGROUND AND SUMMARY OF THE INVENTION

The present invention relates to a drive mechanism for a turntable employed within a microwave oven.

The present invention relates, more particularly, to a drive mechanism for a turntable of the peripheral driven type, wherein a geared portion is circularly formed at the peripheral portion of the lower surface of the turntable. The gear portion is made of a low dielectric loss inorganic material such as glass and ceramics. A drive gear made of a resinous material is associated with the geared portion of the turntable so as to rotate the turntable at a fixed speed.

The turntable is removably engaged with the base of the microwave oven, whereby the turntable is allowed to function as a tableware when the turntable is removed from the microwave oven cavity. The drive gear made of a resinous material extends into a metal gear box such that a drive gear revolution is transferred to the turntable through the circularly formed geared portion.

In such a system, there is the great possibility that the drive gear which is made of a resinous material can be damaged by the microwave energy since the drive gear is extruded through the gear box for power transmission purposes.

Accordingly, an object of the present invention is to provide a drive mechanism for rotating a turntable disposed within a microwave oven.

Another object of the present invention is to protect a drive mechanism for rotating a turntable of the peripheral driven type from the microwave energy generated in a microwave oven.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a reflection means is secured around a drive shaft of the drive gear associated with the circularly formed geared portion of the turntable, and near the drive gear so as to reflect the microwave energy directed to the drive mechanism.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
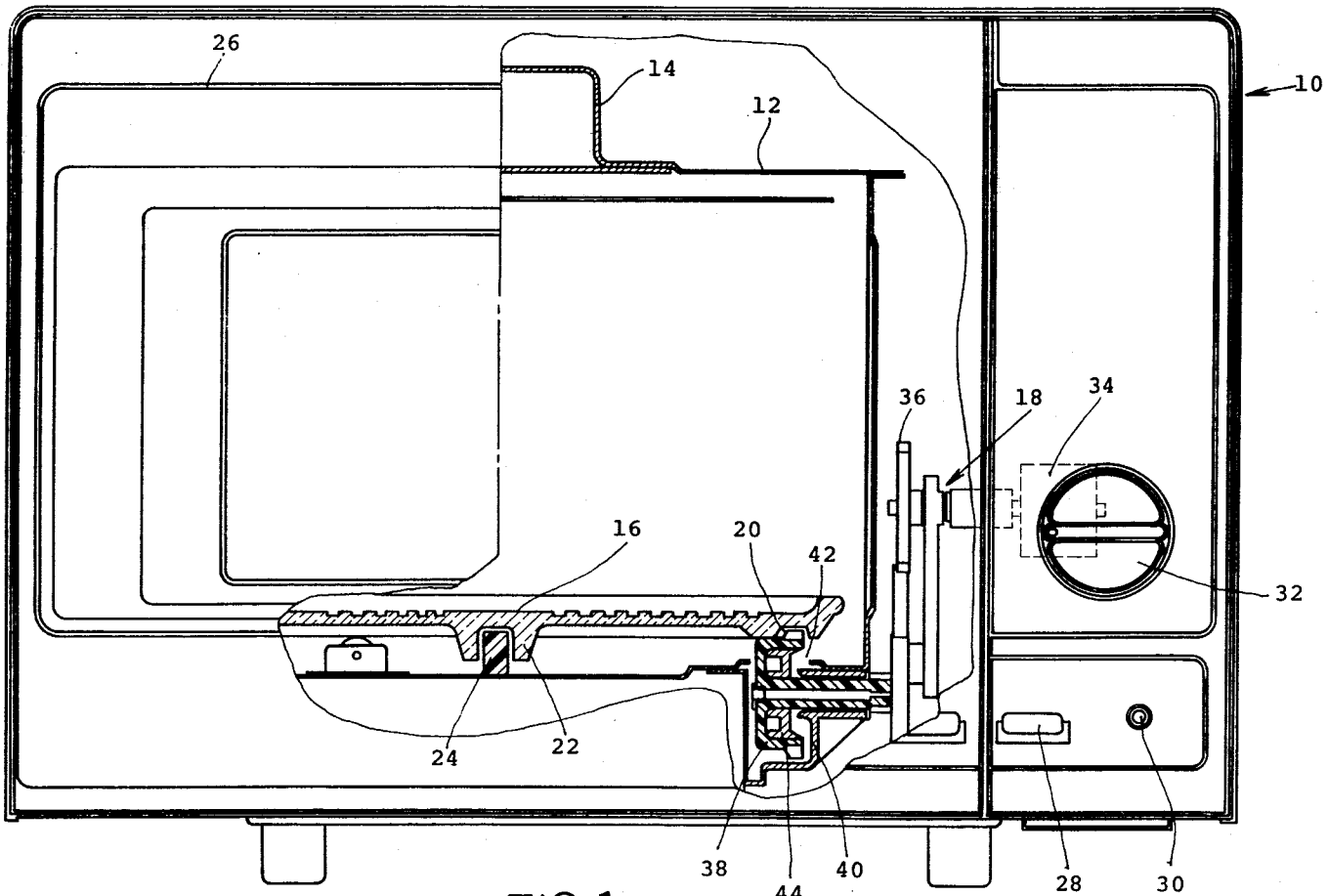
FIG. 1 is a partially sectional front view of a microwave oven including an embodiment of a turntable drive mechanism of the present invention.

FIG. 1 shows a microwave oven including a turntable for supporting a foodstuff mounted thereon and an embodiment of a turntable drive mechanism of the present invention for rotating the turntable at a fixed velocity.

The microwave oven 10 mainly comprises oven walls 12 for defining an oven cavity, a microwave source (not shown) for supplying the microwave energy into the oven cavity through a waveguide 14, a turntable 16 for supporting a foodstuff mounted thereon disposed at the base portion of the oven cavity, and a drive mechanism 18 for rotating the turntable 16 at a fixed velocity.

The turntable 16 is made of a low dielectric loss inorganic material such as glass and ceramics, and is removably engaged with the drive mechanism 18, whereby the turntable 16 is allowed to function as a tableware when the turntable 16 is removed from the microwave oven 10. The turntable 16 includes a circularly formed geared portion 20 provided at the peripheral portion of the lower surface thereof for receiving the driving power from the drive mechanism 18: A projection 22 formed at the center of the lower surface thereof is rotatably secured around a projection 24 fixed to the bottom wall of the oven cavity, whereby the turntable 16 is driven to rotate around the projection 24.

The microwave oven 10 further comprises an oven door 26, a cook switch 28 for conducting the microwave cooking operation, a cook lamp 30 for indicating the microwave cooking operation, and a timer setting knob 32 for determining a period of time of the microwave cooking operation. The control circuit including a microwave generator can be of a conventional construction and hence the details thereof have been omitted for the purpose of simplicity.

The drive mechanism 18 comprises a motor 34, gear assemblies 36, and a drive gear 38 which is operatively associated with the circularly formed geared portion 20 of the turntable 16. The drive gear 38 is made of a resinous material and installed within a gear box 40 made of a metal. The drive gear 38 extends into the gear box 40 and through an opening 42 formed in the upper wall of the gear box 40 where it is geared with the geared portion 20 of the turntable 16. A reflection plate 44 made of metal is disposed within the drive gear 38 so as to reflect the microwave energy directed to the drive gear 38 through the opening 42.

By utilizing the reflection plate 44, the drive gear 38 is protected from the microwave energy which would damage the drive gear 38 which is made of a resinous material.

Figure 2:
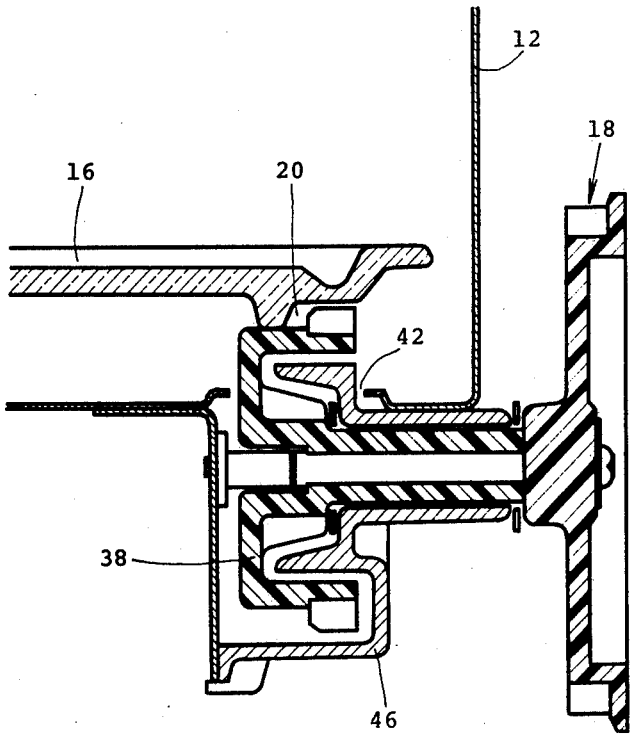
FIG. 2 is a sectional view of an essential part of another embodiment of the turntable drive mechanism of the present invention.

FIG. 2 shows an essential part of another embodiment of the drive mechanism of the present invention. Like elements corresponding to those of FIG. 1 are indicated by like numerals.

In this embodiment, the reflection plate and the gear box are integrally formed as a protection block 46 made of a metal.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a turntable drive mechanism for driving a turntable adapted to rotate a foodstuff mounted thereon at the base portion of a microwave oven the improvement comprising:

a geared portion circularly formed at the peripheral portion of the lower surface of a turntable;

a drive gear associated with said geared portion of the turntable in order to rotate the turntable at a fixed velocity; and a reflection metal means provided near said drive gear in order to protect the drive gear from the microwave energy generated by the microwave oven.

2. In a turntable drive mechanism according to claim 1, wherein the reflection metal means is provided around a shaft of the drive gear and at the side of the drive gear.

3. In a turntable drive mechanism according to claim 1, wherein the drive gear is made of resin.

4. In a turntable drive mechanism according to claim 1, which further comprises:

a turntable motor; and a power transmission means for transferring the turntable motor revolution to said drive gear.

5. In a turntable drive mechanism for driving a turntable rotatably disposed in the base portion of a microwave oven the improvement comprising:

a drive gear assembly including a drive gear, said drive gear being adapted to extend through a wall of the microwave oven and operatively engage a turntable, and a microwave reflective protection means operatively associated with the drive gear, said microwave reflective protection means being adapted to reflect microwave energy directed toward the drive gear.

6. In a turntable drive mechanism according to claim 5, wherein the drive gear extends into a gear box which contains an opening through which the drive gear operatively engages the turntable, said reflective protection means being adapted to reflect microwave energy directed through said opening to the drive gear.

7. In a turntable drive mechanism according to claim 6, wherein the reflective protection means is a reflection plate disposed within the drive gear.

8. In a turntable drive mechanism according to claim 6, wherein the reflective protection means is a reflection plate integrally formed with the gear box to form a protection block.

9. In a turntable drive mechanism according to claim 5, wherein the turntable is provided with a gear portion for engaging the drive gear, said gear portion being disposed at the periphery of the turntable.

10. A turntable device in a microwave oven including a microwave generation means, comprising:

a turntable for supporting a foodstuff mounted thereon;

a microwave-non-reflective drive means for rotating said turntable; and a microwave-reflective protection means provided near said microwave-non-reflective drive means for protecting said microwave-non-reflective drive means for microwave energy generated by said microwave generation means.

11. A microwave oven comprising:

an open cavity;

a microwave generation means communicating with said oven cavity for supplying said oven cavity with microwave energy;

a turntable rotatably disposed within said oven cavity for supporting a foodstuff mounted thereon;

a non-metal drive means operatively communicating with the turntable for rotating said turntable; and a microwave-reflective metal means provided near said non-metal drive means to protect said non-metal drive means from said microwave energy generated by said microwave generation means.

12. A microwave oven comprising:

an oven cavity;

a microwave generation means communicating with said oven cavity for supplying said oven cavity with microwave energy;

a turntable rotatably disposed within said oven cavity for supporting a foodstuff mounted thereon;

a drive mechanism for rotating said turntable;

a non-metal coupling means being exposed to said microwave energy for coupling said drive mechanism with said turntable; and a microwave-reflective metal means provided near said non-metal coupling means to protect said non-metal coupling means from said microwave energy generated by said microwave generation means.

13. The microwave oven of claim 12, wherein the non-metal coupling means is a non-metal drive gear which extends through a wall of the microwave oven into the oven cavity.

14. The microwave oven of claim 13, wherein the non-metal drive gear extends into a gear box disposed within the oven cavity, said gear box containing an opening through which the drive gear operatively engages the turntable, said microwave-reflective metal means being adapted to reflect microwave energy directed through said opening away from the non-metal drive gear.

15. A microwave oven comprising:

an oven cavity;

a microwave generation means communicating with said oven cavity for supplying said oven cavity with microwave energy;

a turntable rotatably disposed within said oven cavity for supporting a foodstuff mounted thereon;

a drive mechanism for rotating said turntable;

a non-metal coupling means being exposed to said microwave energy for coupling said drive mechanism with said turntable;

a microwave-reflective metal means provided near said non-metal coupling means to protect said non-metal coupling means from said microwave energy generated by said microwave generation means;

said non-metal coupling means being a non-metal gear which extends through a wall of the microwave oven into a gear box disposed within the oven cavity, said gear box containing an opening through which the drive gear operatively engages to turntable, said microwave-reflective metal means being adapted to reflect microwave energy directed through said opening away from the non-metal drive gear; and said microwave-reflective metal means being provided around a shaft of the drive gear and at the side of the drive gear 16. The microwave oven of claim 13, wherein the turntable is provided with a gear portion for engaging the drive gear, said gear portion being disposed at the periphery of the turntable.

17. A microwave oven comprising:

an oven cavity;

a microwave generation means communicating with said oven cavity for supplying said oven cavity with microwave energy;

a turntable rotatably disposed within said oven cavity for supporting foodstuff mounted thereon;

a drive mechanism for rotating said turntable;

a non-metal coupling means for coupling said drive mechanism with said turntable, said non-metal coupling means extending through a wall of the microwave oven into the oven cavity; and a microwave-reflective metal means provided near said non-metal coupling means to protect said non-metal coupling means from said microwave energy generated by said microwave generation means.

* * * * *